US007264576B2

(12) United States Patent
Gerschefske et al.

(10) Patent No.: US 7,264,576 B2
(45) Date of Patent: Sep. 4, 2007

(54) ELLIPTICAL EXERCISE DEVICE

(75) Inventors: Kevin Gerschefske, Springfield, MO (US); Robert W. McBride, Springfield, MO (US); Lee San-Ping, Nun-Tou Hsien (TW)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 11/375,044

(22) Filed: Mar. 15, 2006

(65) Prior Publication Data

US 2006/0223679 A1 Oct. 5, 2006

Related U.S. Application Data

(60) Provisional application No. 60/661,513, filed on Mar. 15, 2005.

(51) Int. Cl.
*A63B 21/00* (2006.01)
*A63B 22/12* (2006.01)

(52) U.S. Cl. ..... 482/52; 482/70

(58) Field of Classification Search ..... 482/51, 482/52, 57, 70, 79–80
See application file for complete search history.

(56) References Cited

U.S. PATENT DOCUMENTS

| | | | |
|---|---|---|---|
| 4,786,050 | A | 11/1988 | Geschwender |
| 5,071,115 | A | 12/1991 | Welch |
| 5,116,294 | A | 5/1992 | Findlay |
| 5,129,872 | A | 7/1992 | Dalton et al. |
| 5,242,343 | A | 9/1993 | Miller |
| 5,279,529 | A | 1/1994 | Eschenbach |
| 5,346,451 | A | 9/1994 | Miller |
| 5,352,169 | A | 10/1994 | Eschenbach |
| 5,518,473 | A | 5/1996 | Miller |
| 5,540,637 | A | 7/1996 | Rodgers, Jr. |
| 5,549,526 | A | 8/1996 | Rodgers, Jr. |
| 5,562,574 | A | 10/1996 | Miller |
| 5,622,527 | A | 4/1997 | Watterson et al. |
| 5,848,954 | A | 12/1998 | Stearns et al. |
| 5,857,941 | A | 1/1999 | Maresh et al. |
| 5,935,046 | A | 8/1999 | Maresh |
| 6,063,008 | A | 5/2000 | McBride et al. |
| 6,113,518 | A | 9/2000 | Maresh et al. |
| 6,123,650 | A | 9/2000 | Birrell |
| 6,165,107 | A | 12/2000 | Birrell |
| 6,190,289 | B1 | 2/2001 | Pyles et al. |

(Continued)

OTHER PUBLICATIONS

5200 Magnetic Bike Owner's Manual, Stamina Products, Inc. (Jun. 2003).

(Continued)

*Primary Examiner*—Stephen R. Crow
(74) *Attorney, Agent, or Firm*—Pillsbury Winthrop Shaw Pittman, LLP

(57) ABSTRACT

An elliptical exercise machine in which elongate foot pedaling members are rotatably connected to a crank assembly including a pair of diametrically opposed cranks. Toward one end of each foot pedaling member, an arm is pivotally mounted to the exerciser frame and has a free end with a roller that rollably supports the end of the foot pedaling member. A spring is mounted between the frame and each arm. The springs reduce shock and jarring movement for the user as the user traverses generally elliptical paths using the two foot pedaling members.

19 Claims, 5 Drawing Sheets

U.S. PATENT DOCUMENTS

| | | | |
|---|---|---|---|
| 6,277,055 | B1 | 8/2001 | Birrell et al. |
| 6,340,340 | B1 | 1/2002 | Stearns et al. |
| 6,361,476 | B1 | 3/2002 | Eschenbach |
| 6,482,130 | B1 | 11/2002 | Pasero et al. |
| 2001/0016542 | A1 | 8/2001 | Yoshimura |
| 2002/0028731 | A1 | 3/2002 | Stearns et al. |
| 2002/0142890 | A1 | 10/2002 | Ohrt et al. |
| 2003/0045401 | A1 | 3/2003 | Watterson et al. |
| 2004/0157706 | A1 | 8/2004 | Miller |

OTHER PUBLICATIONS

Electromagnetic Resistance Programmable Elliptical Owner's Manual, Stamina Products, Inc. (Jul. 2003).

ELLIPTICAL EXERCISE DEVICE

RELATED APPLICATION

This application claims priority to and the benefit of U.S. Provisional Application No. 60/661,513, filed Mar. 15, 2005, the entire contents of which is hereby incorporated by reference.

BACKGROUND OF THE INVENTION

1. Field of the Invention

The present invention is directed to exercise apparatuses and, more specifically, to exercise apparatuses in which a user's feet move in generally elliptical paths of motion as the apparatus is pedaled by the user.

2. Description of Related Art

Elliptical exercise devices are devices that allow the user to stand on pedals and to drive the pedals in a manner similar to driving the pedals of a stationary bicycle or stair climbing machine. However, unlike stationary bicycles and stair climbing machines, the pedals of an elliptical exercise device traverse a generally elliptical path as the user pedals them, rather than a circular path. The elliptical path of the foot pedals in such an exercise machine simulates a user's stride in walking or running. A resistance system is typically coupled to the pedals to provide the user with resistance as he or she moves the pedals, so as to increase the intensity of the user's workout. The amount of resistance provided by the resistance system is generally controllable by the user.

Elliptical exercise devices have increased in popularity in recent years and many varieties are now commercially available. Representative examples of these devices are described in, for example, U.S. Pat. Nos. 4,786,050; 5,242,343; 5,279,529; 5,352,169; 5,518,473; 5,540,637; 5,549,526; 5,562,574; and 6,063,008.

In a typical elliptical exerciser, the pedals are mounted on elongate members. One end of each elongate member rotates about a crank connected to the resistance system; the other end of the elongate member is free to translate and pivot and is movable along either a reciprocating path or a closed path. For example, in the exerciser disclosed in commonly-assigned U.S. Pat. No. 6,063,008, the ends of the elongate members are supported by bearings.

Because the elongate members are rigid and are free to translate and rotate on one end, some portions of the pedal movements may be jarring for the user. It is advantageous if jarring movement of the pedals can be reduced or eliminated, in order to increase the user's comfort and reduce the likelihood of injury caused by jarring movement of the pedals.

Resilient elements such as springs are sometimes used in elliptical exercisers, although configurations that include springs do not generally reduce jarring movement in the exerciser. For example, U.S. Pat. No. 5,857,941 to Maresh discloses an elliptical exerciser in which the resistance system is coupled to the elongate members by means of a rack and pinion system. Compression springs are used to keep the rack elements in engagement with the pinion elements.

U.S. Patent Application Publication No. 2003/0045401 A1 of Watterson et al. (corresponding to U.S. application Ser. No. 09/943,741) discloses one potential solution to the problem of jarring pedal movement. In the Watterson et al. publication, the elongate members on which the pedals are mounted are leaf springs, which adds resiliency to the movement of the pedals, thereby damping the movements of the pedals. Making the elongate members leaf springs may be relatively costly. Other arrangements are disclosed in U.S. Patent Application Publication No. 2004/0157706.

SUMMARY OF THE INVENTION

One aspect of the invention relates to an exerciser. The exerciser comprises a frame constructed and arranged to be mounted stably on a horizontal surface. Left and right elongated foot pedaling members of the exerciser each include a forward end, a rearward end, and a foot receiving structure between the forward and rearward ends. A crank assembly is mounted on the frame for rotation about a generally horizontal axis. The crank assembly includes a left crank rotatably connected to one end of the left elongated foot pedaling member and a diametrically opposed right crank rigidly fixed with respect to the left crank and rotatably connected to one end of the right foot pedaling member. Left and right arms are each pivoted at one end thereof to the frame and have a free end spaced from the pivoted end. Left and right springs are each connected between the frame and an associated left or right arm. The springs are constructed and arranged to resiliently bias the free end of the associated left or right arm upwardly into a limiting position and to allow resilient downward movement of the associated left or right arm away from the limiting position. Left and right rollers are rotatably mounted on the free ends of the left and right arms, respectively, so that the foot engaging structures of the left and right foot pedaling members move in a substantially elliptical path as the user moves the left and right foot pedaling members through 180° out of phase cycles each including a pumping stroke when the associated crank is moving downwardly and a return stroke when the associated crank is moving upwardly. The left and right springs are constructed and arranged to enable the left and right arms to freely resiliently yield away from the limiting position thereof in response to the pumping stroke of the associated foot pedaling member by virtue of the force transmittal thereto of the associated pedaling member through the associated roller and to freely resiliently return during the return stroke of the associated foot pedaling member. An adjustable movement resisting mechanism is constructed and arranged to provide a resistance to the cycle of movement of the foot pedaling members by a user which can be adjusted so as to vary the amount of resistance provided.

Other aspects, features, and advantages of the present invention will be made clear in the following description.

BRIEF DESCRIPTION OF THE DRAWINGS

The invention will be described with respect to the following drawing Figures, in which like numerals represent like structures throughout the Figures, and in which.

DETAILED DESCRIPTION

Figure 1:
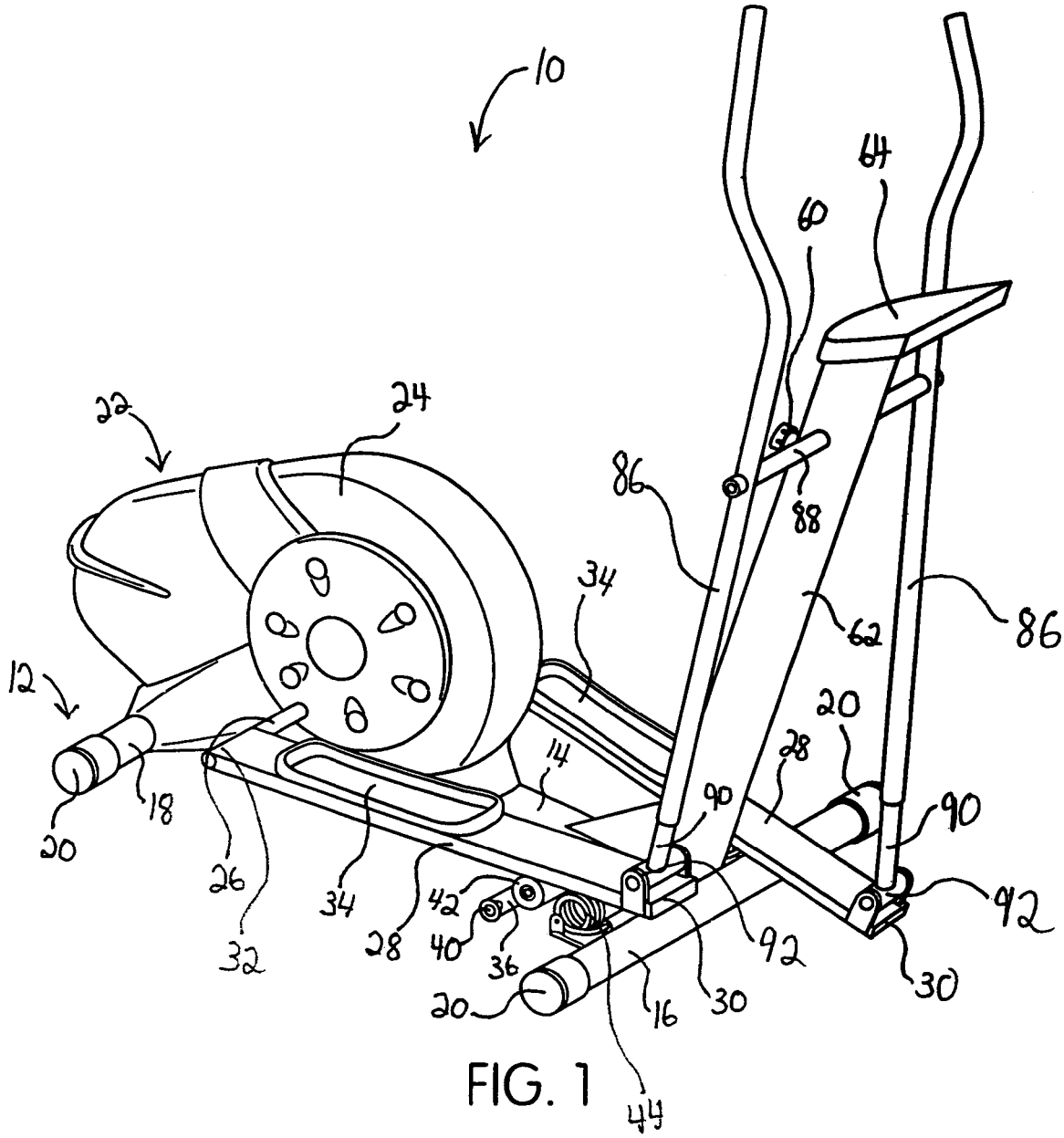
FIG. 1 is a perspective view of an embodiment of an exerciser according to the invention.

FIG. 1 is a perspective view of an exerciser, generally indicated at 10, according to one embodiment of the present invention. The exerciser 10 is supported by its frame, generally indicated at 12, which is constructed and arranged to rest on or be mounted stably on a horizontal surface. The frame 12 includes a main frame member 14, which extends substantially the entirety of the length of the exerciser 10, a front lateral stabilizer 16 and a rear lateral stabilizer 18. The front and rear lateral stabilizers 16, 18 would typically be connected to the main frame member 18 by fasteners, welds, or other suitable connection methods. Both the front 16 and rear 18 lateral stabilizers are generally tubular members and, as illustrated in FIG. 1, the ends of the front 16 and rear 18 lateral stabilizers are capped by friction reducing end caps 20.

A crank and resistance assembly, generally indicated at 22, is mounted to the main frame member 14, and is largely enclosed by a housing 24, which conceals the internal structure of the crank assembly 20 so as to prevent damage to the mechanism and to provide a pleasing appearance for a user. Diametrically opposed left and right cranks 26 extend from respective left and right sides of the crank and resistance assembly 22. (FIG. 1 shows only one side of the exerciser 10; the two cranks 26 are identical to one another.)

The exerciser 10 also provides left and right elongate foot pedaling members 28, each having forward 30 and rearward 32 ends. The rearward ends 32 of the two foot pedaling members 28 are rotatably connected to the left and right cranks 26 of the crank and resistance assembly 22 by conventional pivot structure and associated bushings 27. In between the forward 30 and rearward 32 ends, each foot pedaling member 28 includes a foot receiving structure 34, which is contoured to provide traction for the foot of a user while the user exercises on the apparatus 10. To that end, each foot receiving structure 34 has upwardly contoured edges that act as stops for the foot. Although not shown in FIG. 1, each foot receiving structure 34 may also include one or more contoured traction surfaces.

Toward the forward ends 30 of the foot pedaling members 28, left and right arms 36, 38 are provided. Each arm 36, 38 is pivotably attached to the main frame member 14 by a pivot structure 40 at one end and extends generally forwardly therefrom. On the free end of each arm 36, 38, a roller 42 is attached. As will be described below in more detail, respective left and right springs 44 are mounted between the frame 12 and respective left and right arms 36, 38. With this arrangement, the arms 36, 38 rollingly engage portions of the left and right foot pedaling members 28 so that the foot engaging structures 34 of the foot pedaling members 28 move in a substantially elliptical path as the user moves the left and right foot pedaling members 28 through 180° out of phase cycles, each cycle including a pumping stroke when the associated crank 26 is moving downwardly and a return stroke when the associated crank 26 is moving upwardly. The springs 44 allow the arms 36, 38 to yield resiliently on the pumping stroke of each foot pedaling member 28 and resiliently return to their original, limiting position during the return stroke, causing the arms. The resilient return of the springs 44 during the return stroke and the corresponding movement of the arms 36, 38 reduces any jarring movement that might otherwise be experienced by the user. As shown in FIG. 1, in their limiting position, the free ends of the arms 36, 38 with rollers 42 are positioned above the pivot structure 40.

Figure 2:
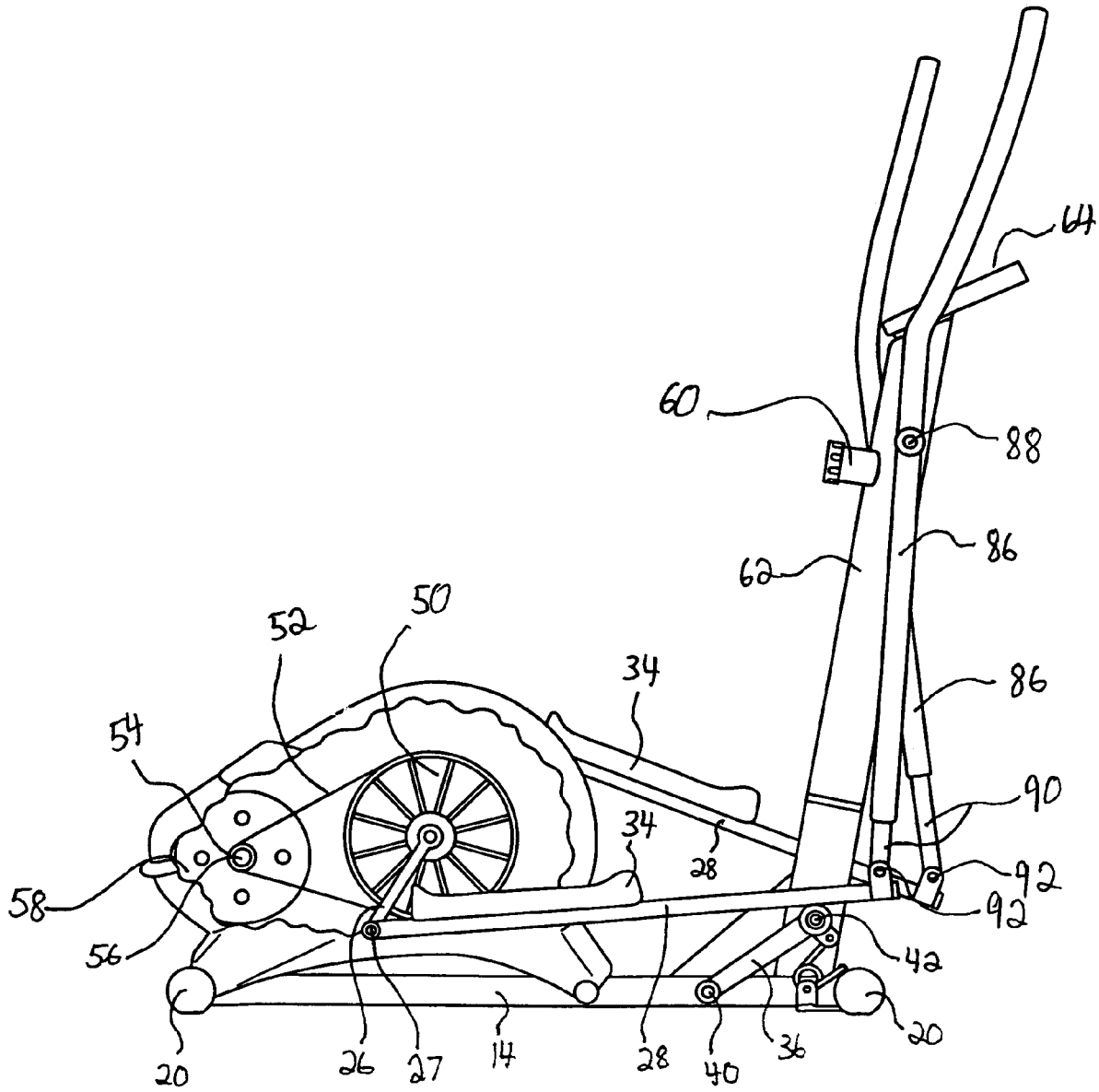
FIG. 2 is a side elevational view of the exerciser of FIG. 1 with certain portions of a housing shown in FIG. 1 cut away to reveal internal details of the exerciser's resistance system.

FIG. 2 is a side elevational view of one side of the exerciser 10 with portions of the housing 24 removed to show some of the workings of the crank and resistance assembly 22. The precise workings of the crank and resistance assembly 22 are not critical to the present invention and, accordingly, the assembly 22 may be implemented in a number of different ways. One such way of implementing the assembly will be described here in general terms. Specifically, in the embodiment illustrated in FIG. 2, the crank and resistance assembly 22 generates resistance through a permanent magnet eddy current braking system.

Each crank 26 is connected to a large pulley 50 that is mounted to the main frame member 14 for rotation within the housing 24. A belt 52, such as a V-belt, is trained over the outer circumference of the large pulley 52 and runs to a small pulley 54 connected to the input shaft 56 of a magnetic braking system 58. The difference in diameter between the large pulley 52 and the small pulley 54 causes the input shaft 56 of the magnetic braking system 58 to rotate faster than the large pulley 52, so as to facilitate magnetic braking action. The magnetic braking system 58 itself is stationary, except that it may be mounted to the frame 12 within a slot so as to allow sliding movement of the magnetic braking system 58 to properly tension the belt 52. The sliding tensioning movement of the magnetic braking system 58 may be controlled by a motor.

Although not shown in FIG. 2, the input shaft 56 is connected to and rotates a flywheel with a heavy offset rim and an interior conducting portion, which may be in the form of a ring. For example, the flywheel may be made of heavy cast iron and the interior conducting portion or ring may be made of aluminum, which is a better electrical conductor than the cast iron. Two permanent magnets are attached to the interior surface of the magnetic system 58 by means of curved plates, one positioned on each side of the flywheel, so as to induce eddy currents in the flywheel, thereby creating resistance to the movement of the flywheel. To vary the level of resistance, the two permanent magnets are moved toward and away from the flywheel by a cable-driven system that is connected to a resistance adjustment knob 60 mounted on an upright support member 62 of the exerciser 10. Alternatively, the cable and adjustment knob 60 may be carried externally by the upright support member 62. The position of the resistance adjustment knob 60 is generally selected so as to be in a comfortably reachable position for an exercising person, and may be varied in position, particularly if it is carried externally by the upright support member 62.

As those of ordinary skill in the art will realize, exercisers 10 according to the present invention may also use more sophisticated electromagnetic braking systems analogous to that shown in U.S. Pat. No. 6,482,130 of Pasero et al., the contents of which are incorporated herein by reference. Essentially, instead of using two permanent magnets and varying the distance between the permanent magnets and the flywheel of the magnetic resistance system 58 to vary the resistance, the magnetic resistance system 58 could use two electromagnets mounted at fixed distances from the flywheel and could vary the current to the electromagnets to vary the resistance.

However, if a non-magnetic resistance system is desired, the housing 24 could contain a more traditional non-magnetic resistance system, such as the resistance system disclosed in U.S. Pat. No. 6,063,008, the contents of which are incorporated by reference herein in their entirety. In that resistance system, a tension strap is trained around the outer circumference of a heavy flywheel. The resistance level is varied by using a cable driven system to tighten and loosen the tension strap. If such a system is included in an exerciser according to the invention, the cable controlling the tension level in the resistance system may be connected to a resistance adjustment knob like resistance adjustment knob 60 mounted on the upright support member 62.

Regardless of the particular type of resistance system, the housing 24 may also incorporate a speed/distance sensor, typically a two-part sensor comprising a permanent magnet mounted on the large pulley 50 or other rotating portion of the crank and resistance assembly 22 and a stationary sensor, such as a Hall Effect sensor, that is capable of registering the increase in magnetic field that occurs when the permanent magnet rotates close to the sensor. The output from the sensor may be displayed (in any desired format or any unit, measured or derived) on the display panel 64 mounted on the upright support member 62.

Figure 3:
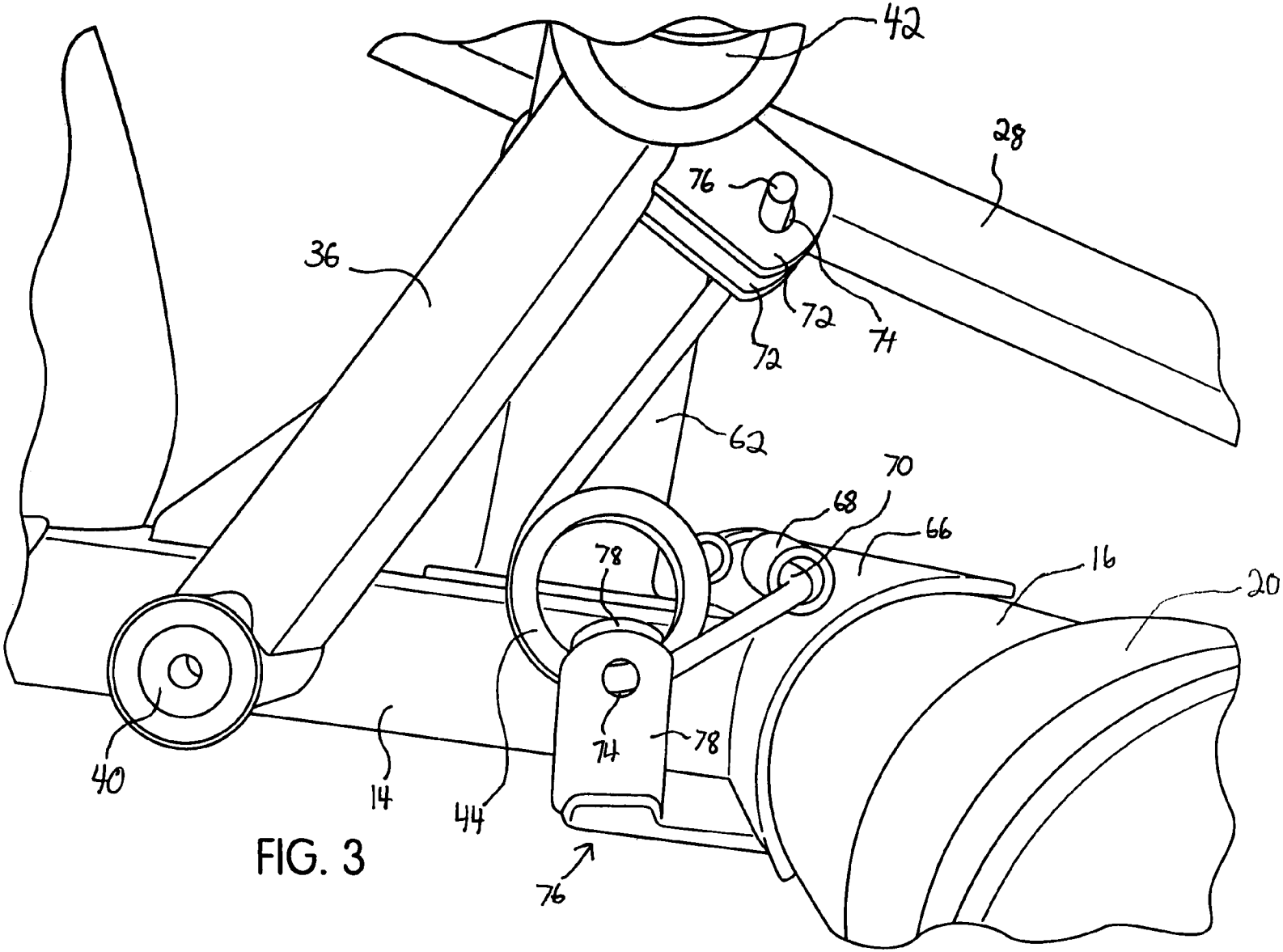
FIG. 3 is a side elevational view of a front portion of the exerciser of FIG. 1 illustrating the placement of a spring between the frame of the exerciser and an arm supporting one of the exerciser's foot pedaling members.

FIG. 3 is a perspective view of a lower forward side portion of the exerciser 10 showing one of the springs 44 and its attachment in more detail. As shown in FIG. 3, the main frame member 14 terminates in a curved plate 66 which is welded, bolted, or otherwise attached to the front lateral stabilizer 16. Attached to the plate 66 is a cylindrical channel 68 that receives a first end 70 of one of the springs 44, which is bent into an inturned "L" shape. Two parallel brackets 72 extend from the downwardly-facing surface of the arm 36; each bracket 72 has a hole 74 that is co-linear with the hole 74 of the other bracket 72. Together, the two brackets 72 with holes 74 define a channel for the second end 76 of the spring 44. The channel defined by the holes 74 and the cylindrical channel 68 extend generally parallel to the orientation of the lateral stabilizers 16, 18 and generally transverse to the orientation of the main frame member 14. However, the orientation and position of the brackets 72 and the channel 68 may be varied or replaced by other conventional receiving structures, and the ends 70, 76 of the springs 44 may be shaped or angled as necessary to cooperate with whatever sort of receiving structures are provided.

In order to prevent the spring 44 from moving laterally, a bracket assembly 76 is connected to the curved plate 66. The bracket assembly 76 includes two vertical bracket members 78 that extend upwardly, one bracket member 78 on each side of the main coil of the spring 44. If more control is desired over the vertical position of the spring 44, a pin may be inserted through a set of co-linear holes 74 provided in the bracket members 78. The pin would be positioned such that it is inside the main coil of the spring 44.

FIG. 3 also illustrates the pivot structure 40 and a portion of the roller 42. Although embodiments of the invention could employ a simple pivot for each of the arms 36, for smoother movement, the pivot structures 40 are preferably comprised of a rotating portion journally supported on a pivotal shaft (e.g. with appropriate lubrication, ball bearings, etc.) for relatively free rotational movement about the shaft. The rotating portion would typically be a portion of the arm 36 or would be connected to the arm 36 so as to allow the arm 36 to rotate with the rotating portion. The roller 42 would typically be a similar conventional structure in which a rotating portion is journally supported on a shaft.

Figure 4:
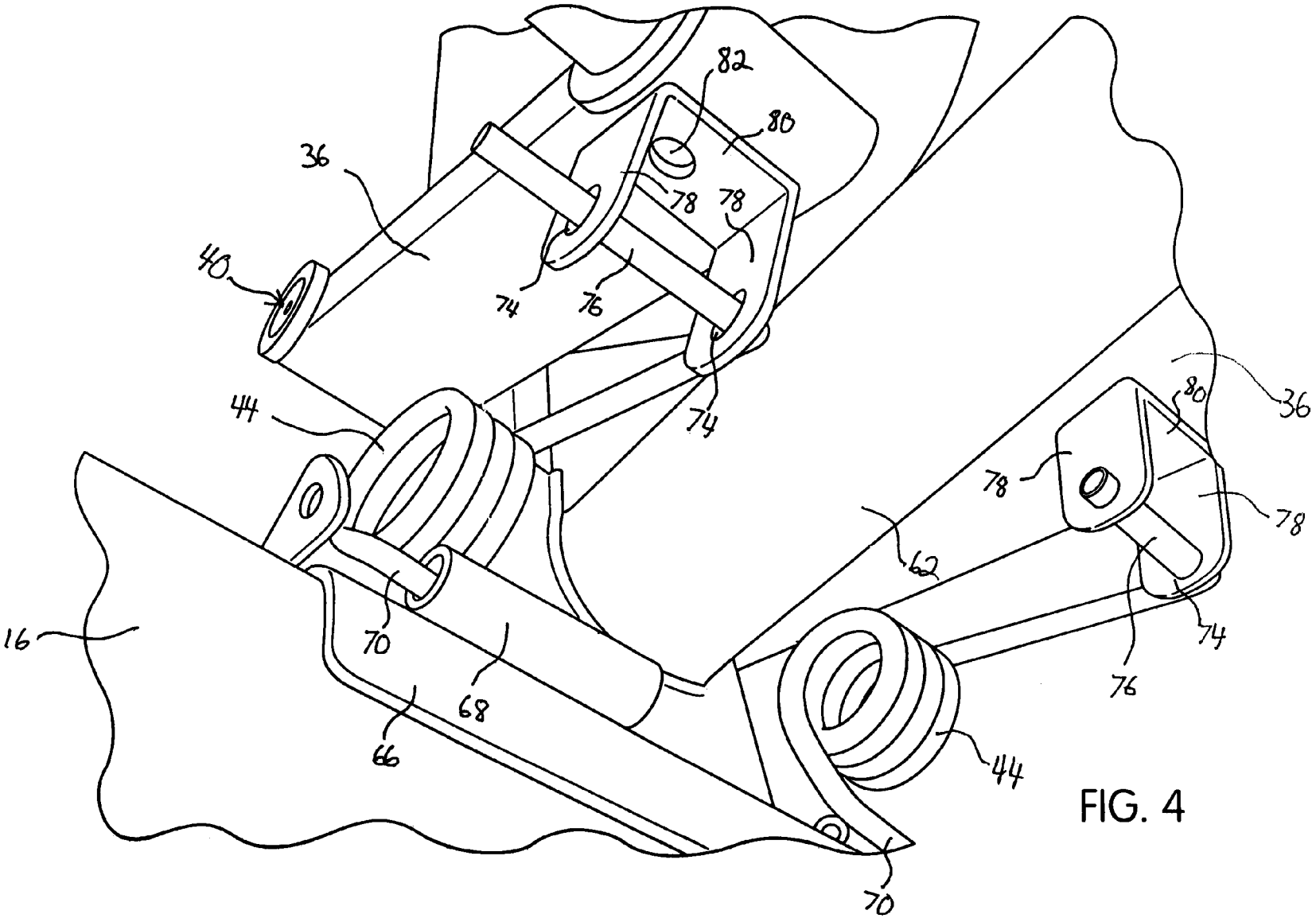
FIG. 4 is a perspective view of the underside of the front portion of the exerciser, showing the arrangement and connection of the springs.

FIG. 4 is a perspective view of the underside of the exerciser 10 showing the springs 44 and their attachment in more detail. The view of FIG. 4 shows both arms 36, the brackets 78 secured to the underside of each arm 36, and the insertion of the respective ends 70, 76 of the springs 44. As shown, the two brackets 78 of this embodiment are formed as one piece and a crossmember 80 extends between them, although this need not be the case. Typically the brackets 78 would be fixedly secured by welding, although other securing means such as bolts and adhesives may be used. (As is shown in FIG. 4, the crossmember 80 includes a hole 82 that may be used for a bolt.) The two brackets 78 on each arm 36, if not joined together by a crossmember 80, may be individually bolted, welded, or otherwise secured to the arms 36.

The two channels 68 that receive first ends 70 of the springs 44 would also typically be welded, formed integrally with the curved plate 66, or secured to a plate that is, in turn, bolted or otherwise secured to the curved plate 66. Additionally, as those of skill in the art will realize, the function of the channels 68 may be performed by brackets 78 or other similar structures; the channels 68 are merely more compact than some other structures that might be used for the same purpose. As can be appreciated from FIGS. 3 and 4, when the arms 36, 38 yield away from their limiting positions and rotate clockwise in response to the pumping stroke of each foot pedaling member 28, the ends 70, 76 of the springs 44 move clockwise toward one another.

Although the exerciser 10 includes torsional springs 44, compression springs could also be used in embodiments of the invention. In that case, instead of the channels 68 and brackets 78, engaging and/or receiving structures suitable for the ends of the compression springs would be provided.

A portion of the upright member 62 is shown in FIG. 4 as well. The upright member 62 is attached to the main frame member 14 and extends upwardly therefrom. As shown in FIGS. 1 and 2, grip poles 86 are pivotally connected to the front ends 30 of the foot pedaling members 28 and extend upwardly therefrom, generally parallel to the upright member 62. Each of the grip poles 86 provides the user with a place to grip, upper body support, and some upper body exercise during the elliptical movements of the foot pedaling members 28. As shown, each of the grip poles 86 is mounted for rotation on and supported by a crossmember 88 carried by the upright member 62. The crossmember 88 provides a generally horizontally extending pivotal axis for each grip pole 86. Each grip pole 86 is also constructed to telescopically change length during the elliptical movements of the foot pedaling members 28 and includes a telescoping portion 90 adjacent to the pivot 92 that connects it to one of the front ends 30 of the foot members 28. The telescoping portions 90 allow the grip poles 86 to follow the positions of the foot pedaling members 28 while remaining at heights and positions that are convenient for the user.

Many other types of hand gripping and upper body support structures are known in the art and may be used with exercisers according to the invention. For example, U.S. Pat. No. 6,063,008 (which was incorporated by reference above) includes a handrail structure that is stationary with respect to its foot pedaling members.

At the top of the upright support member 62 is the display panel 64. In addition to the functions of the display panel 64 that were described above, including speed measurement, the display panel 64 may also include a variety of other information, and may include some calculating ability, e.g., from an installed microprocessor, ASIC, or other computing device. For example, the display panel 64 may display the number of calories expended in exercise, based upon the user's weight (typically input into the display panel 64 by the user), the speed at which the user is moving (as determined by sensors), and the time interval during which the user as been exercising. In addition, the display panel 64 may display the output from biological sensors connected to it. For example, a pulse meter may be connected to the display panel 64 in some embodiments and its output displayed on the display panel 64.

Figure 5:
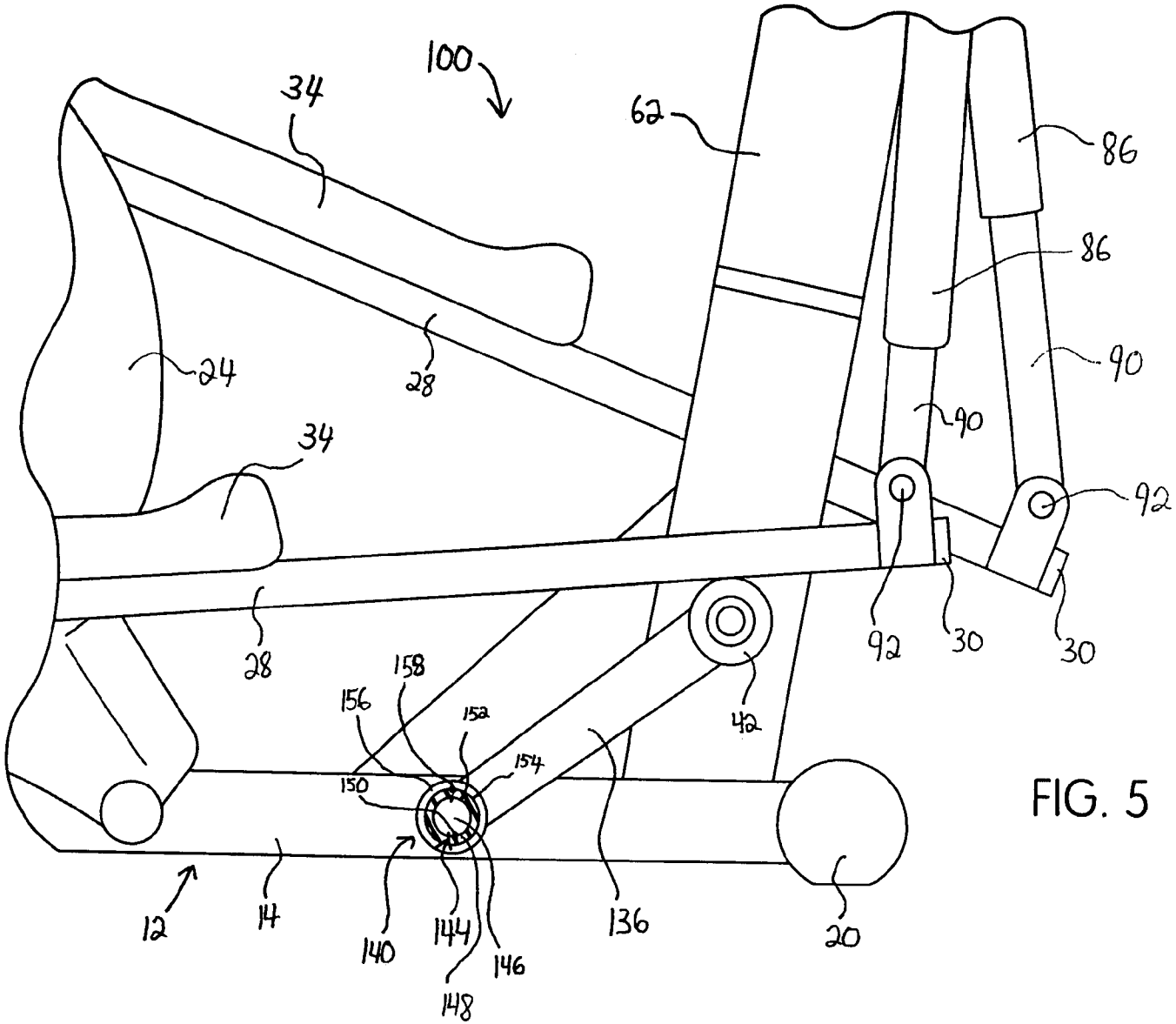
FIG. 5 is a side elevational view of a portion of an exerciser according to another embodiment of the invention.

As was noted above, the springs provided in embodiments of the present invention need not be the torsion springs shown in FIGS. 1–4; many other configurations are possible. For example, FIG. 5 is a side elevational view of a portion of an exerciser 100 according to another embodiment of the invention. In the exerciser 100, the torsion springs 44 have been replaced by elastomeric torsion springs, generally indicated at 144, that are directly coupled to the pivot 140 of each of the arms 136. Because the exerciser 100 does not include the springs 44, the brackets 68, 72, 76 that are present in the exerciser 10. Otherwise, the configuration of the exerciser 100 is identical to that of the exerciser 10. Moreover, the two sides of the exerciser 100 are mirror images of one another.

More specifically, as is shown in FIG. 5, the pivot 140 of the arm 136 is comprised of several pieces, positioned generally concentrically with respect to one another. The innermost component of the pivot 140 is the stationary hub 146, which is typically a round bar fixed to and extending outwardly from the frame 12 of the exerciser 100. Positioned around the hub 146 is an elastomeric material 148, such as an elastomeric rubber, which, together with its attachments, comprises the elastomeric torsion spring 144. The elastomeric material 148 may be a strip or a ring of material. A first portion 150 of the elastomeric material 148, typically one end if a strip, is attached to the hub 146 along its inner face 152. The outer face 154 of the elastomeric material 148 is housed in a cylindrical, mating portion 156 of the arm 136, and a second portion 158 of the elastomeric material 148 is attached to the inside of the mating portion 156 of the arm 136 along the outer face 154. The first portion 150 of the elastomeric material 148 is typically separated from the second portion 158 by some distance, so that the elastomeric material 148 can stretch and/or compress as necessary.

With the first portion 150 of the elastomeric material 148 attached to the hub 146 and the second portion 158 of the elastomeric material 148 attached to the mating the arm 136, the elastomeric material 148 is mounted between the hub 146 and the arm 136 such that motion of the arm 136 relative to the hub 146 causes the elastomeric material 148 to stretch and/or compress, which biases the arm 136 to return resiliently to its original position. The thickness and elastic modulus of the elastomeric material 148 may be chosen so as to define a particular level of spring force.

The elastomeric material 148 need not encircle the entire hub 146, and may instead extend along only a portion of it. If the elastomeric material 148 does extend along only a portion of the hub 146, bushings and other spacers may be provided between the hub 146 and the mating portion 156 of the arm 136 to maintain the spacing between them.

Although the invention has been described with respect to certain exemplary embodiments, those embodiments are intended to be exemplary, rather than limiting. Modifications and variations may be made within the scope of the following claims.

What is claimed is:

1. An exerciser comprising:

a frame constructed and arranged to be mounted stably on a horizontal surface;

left and right elongated foot pedaling members each including a forward end and rearward end and a foot receiving structure between said rearward and forward ends;

a crank assembly mounted on said frame for rotation about a generally horizontal axis;

said crank assembly including a left crank rotatably connected to one end of said left foot pedaling member and a diametrically opposed right crank rigidly fixed with respect to said left crank and rotatably connected to one end of said right foot pedaling member;

left and right arms each pivoted at one end thereof to said frame and having a free end spaced from the one end thereof;

left and right springs each connected between said frame and an associated left or right arm constructed and arranged to resiliently bias the free end of the associated left or right arm upwardly into a limiting position and to allow resilient downward movement of the associated left or right arm away from said limiting position;

left and right rollers rotatably mounted on the free ends of said left and right arms, respectively, constructed and arranged to rollingly engage opposite end portions of said left and right foot pedaling members, respectively, so that the foot engaging structures of said left and right foot pedaling members move in a substantially elliptical path as the user moves the left and right foot pedaling members through 180° out of phase cycles each including a pumping stroke when the associated crank is moving downwardly and a return stroke when the associated crank is moving upwardly;

said left and right springs being constructed and arranged to enable the left and right arms to freely resiliently yield away from the limiting position thereof in response to the pumping stroke of the associated foot pedaling member by virtue of the force transmittal thereto of the associated pedaling member through the associated roller and to freely resiliently return during the return stroke of the associated foot pedaling member; and an adjustable movement resisting mechanism constructed and arranged to provide a resistance to the cycle of movement of said foot pedaling members by a user which can be adjusted so as to vary the amount of resistance provided.

2. The exerciser of claim 1, wherein the left and right arms are each oriented such that the one ends of said arms are oriented forwardly with respect to the pivoted ends of said arms.

3. The exerciser of claim 2, wherein the left and right arms are oriented such that the one ends of said arms are above the pivoted ends of said arms when said arms are in the limiting positions thereof.

4. The exerciser of claim 3, wherein the springs are torsion springs.

5. The exerciser of claim 4, wherein the torsion springs have first and second ends and a coil disposed between said first and second ends, the first ends being constructed and arranged to be received in respective receiving structures coupled to said frame, and the second ends being constructed and arranged to be received in respective receiving structures coupled to said arms.

6. The exerciser of claim 5, wherein the first and second ends of said springs are inturned and received in transversely-extending channels coupled to the frame and the arms, respectively.

7. The exerciser of claim 5, wherein the first and second ends of said torsion springs move toward one another as said arms yield away from the limiting positions.

8. The exerciser of claim 5, wherein lateral retaining structure is provided to constrain the main coils of said springs to prevent lateral movement thereof.

9. The exerciser of claim 1, further comprising hand grips coupled to said frame and extending upwardly therefrom.

10. The exerciser of claim 9, wherein said hand grips are telescopic members pivotally connected to said foot pedaling members for movement between relatively retracted and relatively extended positions corresponding to positions of said foot pedaling members.

11. The exerciser of claim 1, further comprising a front upright member.

12. The exerciser of claim 11, wherein said hand grips are mounted for pivotal rotation on a crossmember connected to said front upright member.

13. The exerciser of claim 1, wherein said adjustable movement resisting mechanism is coupled to said left and right cranks.

14. The exerciser of claim 13, wherein said adjustable movement resisting mechanism comprises:

a pulley connected to said left and right cranks;

a resistance member; and a belt connected between said pulley and a portion of said resistance member so as to convey motion from said left and right cranks through said pulley and into said resistance member.

15. The exerciser of claim 14, wherein said resistance member comprises a flywheel.

16. The exerciser of claim 14, wherein said adjustable movement resisting mechanism further comprises magnetic structure constructed and arranged to induce movement resistive eddy currents in said flywheel as said flywheel turns in response to motion imparted by said belt.

17. The exerciser of claim 14, wherein said adjustable movement resisting mechanism further comprises frictional structure constructed and arranged to impede the movement of said flywheel as said flywheel turns in response to motion imparted by said belt; and adjusting structure constructed and arranged to vary frictional force imposed on said flywheel by said frictional structure.

18. The exerciser of claim 14, wherein said adjustable movement resisting mechanism is provided in a housing mounted on a rearward portion of said frame.

19. The exerciser of claim 1, wherein said springs comprise elastomeric materials mounted between the pivoted ends of said arms and portions of said frame about which said arms are pivoted.

* * * * *